United States Patent [19]

Glass et al.

[11] Patent Number: 4,849,867

[45] Date of Patent: Jul. 18, 1989

[54] LIGHT FIXTURE AND LOUVER CONSTRUCTION

[75] Inventors: Walter Glass, Northfield; Herman van der Vaart, Chicago Heights, both of Ill.

[73] Assignee: Litecell, Inc., Skokie, Ill.

[21] Appl. No.: 207,717

[22] Filed: Jun. 16, 1988

[51] Int. Cl.[4] ..... F21V 7/00

[52] U.S. Cl. ..... 362/342; 362/291

[58] Field of Search ..... 362/217, 260, 290, 291, 362/292, 342, 364, 325

[56] References Cited

U.S. PATENT DOCUMENTS

| | | | |
|---|---|---|---|
| 2,971,083 | 2/1961 | Philips et al. | 362/342 |
| 4,268,897 | 5/1981 | Schierwagen et al. | 362/342 X |
| 4,780,800 | 10/1988 | Mullins | 362/342 |

*Primary Examiner*—Stephen F. Husar

*Attorney, Agent, or Firm*—Willian Brinks Olds Hofer Gilson & Lione

[57] ABSTRACT

A light fixture including a louver assembled from blades formed of thin metal strips. The blades each have separate parabolic lower sidewalls and upper sidewalls. The parabolic upper sidewalls terminate in edge strips which overlap to close the blades when the blades are nested to form the louver. Nesting of the blades forces the sidewalls together against a resilient bias, the bias tending to rigidify the louver after assembly.

5 Claims, 3 Drawing Sheets

LIGHT FIXTURE AND LOUVER CONSTRUCTION

FIELD OF THE INVENTION

This invention is in the field of lighting. It relates particularly to louvers for controlling and directing light emitted from fluorescent and other types of lamps, including incandescent and high intensity discharge (HID) lamps.

BACKGROUND OF THE INVENTION

The most common system for lighting office, commercial, and industrial space is overhead lighting. Conventional overhead lighting normally uses tubular fluorescent lamps, incandescent lamps, or HID lamps as a light source. In many applications, the light which radiates from the lamps is passed through a louver which is effective to focus and direct the radiating light downwardly.

A louver is a grid-like structure comprising perpendicularly intersecting blades. The louver may be formed in one piece of plastic or it may be assembled from multiple pieces formed of aluminum, for example.

A louver which is made of aluminum can readily be used with either fluorescent lamps, which give off relatively little heat, or with incandescent or HID lamps, which may give off substantial amounts of heat. On the other hand, plastic louvers tend to deteriorate if subjected to the heat of incandescent or HID lamps.

Regardless of whether louvers are molded of plastic or formed of aluminum, the blades preferably have parabolic surfaces defining their primary reflective surfaces. These parabolic surfaces are vertically elongated and serve to enhance the light reflection characteristics of the louver as it modifies light emitted from the lamps above the louver.

SUMMARY OF THE INVENTION

An object of the present invention is to provide a light fixture which includes louvers assembled from multiple pieces of reflective metal such as aluminum or the like. It is another object to provide a light fixture which includes an improved metal louver construction. It is another object to provide an improved metal louver construction. Still another object is to provide a metal louver construction wherein parabolic sidewall surfaces are formed on upper sidewalls of the blades as well as louver sidewalls. A further object is to provide a louver construction wherein louver blades formed of sheet metal have closed top surfaces. Still a further object is to provide a louver construction wherein the closed top surfaces of each blade are formed by metal strips forced into overlapping relationship by the other blade when the blades are nested.

BRIEF DESCRIPTION OF THE DRAWINGS

The invention, including its construction and method of operation, together with other objects and advantages thereof, is illustrated more or less diagrammatically in the drawings, in which.

DESCRIPTION OF THE PREFERRED EMBODIMENT

Figure 1:
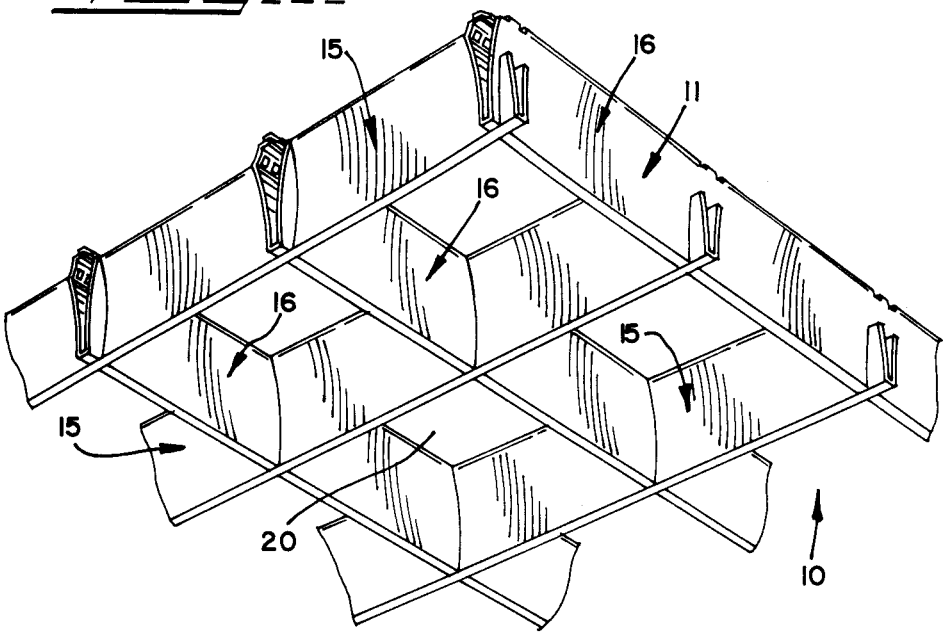
FIG. 1 is a perspective view of a portion of a louver embodying features of the present invention, looking up from the bottom of the louver.
Figure 2:
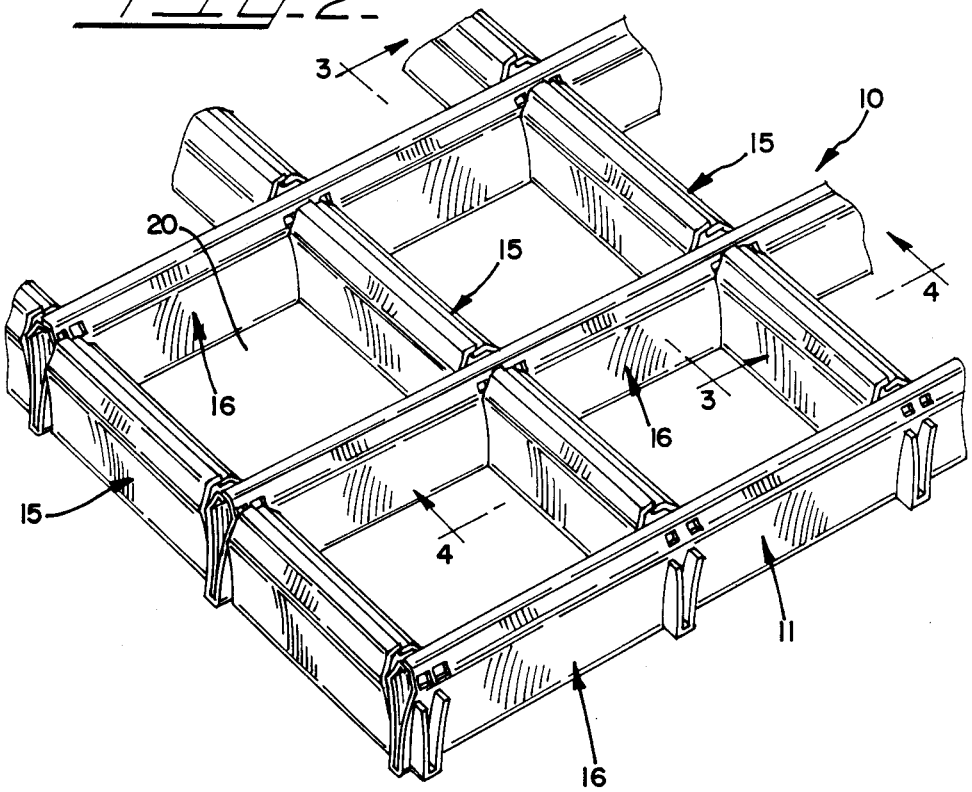
FIG. 2 is a perspective view of the portion of the louver illustrated in FIG. 1, looking down from the top.

Referring now to the drawings, and particularly to FIGS. 1 and 2, a portion of a louver embodying features of the present invention is illustrated generally at 10. The louver 10 comprises a rectangular grid 11 formed of a plurality of longitudinally extending blades 15 interconnected with a plurality of transversely extending blades 16.

Each of the blades 15 and 16 is formed independently from thin, elongated, rectangular strips of aluminum. Each strip is shaped by die cutting and "roll forming" to form an individual blade 15 or 16.

All of the blades 15 are formed with a first configuration. All of the blades 16 are formed with a second configuration. As will be hereinafter discussed the configurations of the blades 15 and 16 are such that they nest and lock together without the use of separate locking elements.

Figure 5:
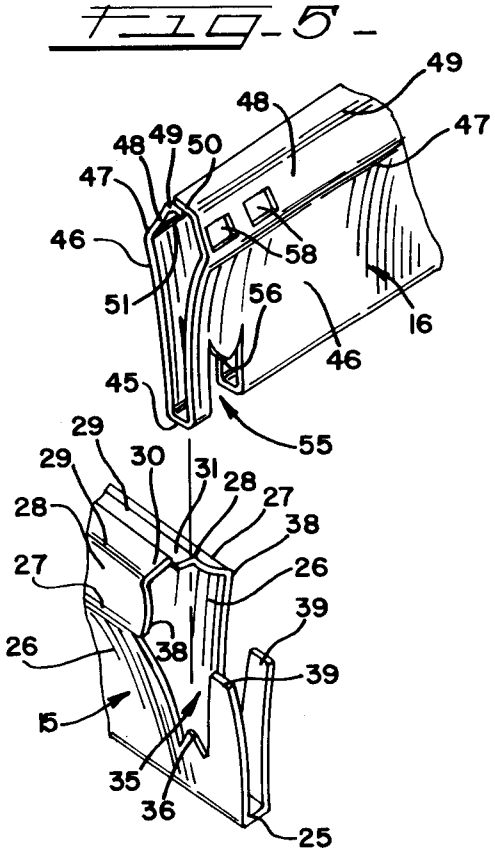
FIG. 5 is an exploded view of louver blades constructed and arranged according to the invention, as they are assembled into the louver of the invention.
Figure 3:
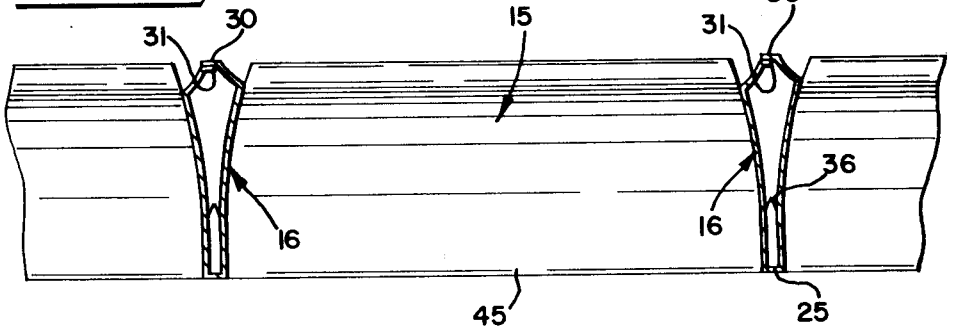
FIG. 3 is an enlarged sectional view taken along line 3—3 of FIG. 2.
Figure 4:
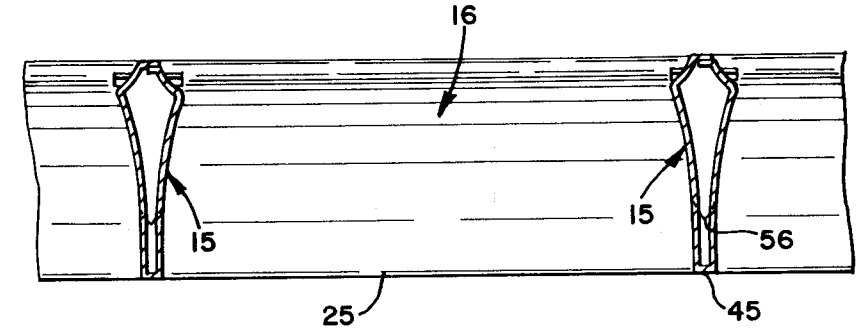
FIG. 4 is an enlarged sectional view taken along line 4—4 of FIG. 2.

Referring now to FIGS. 3–5, in addition to FIGS. 1 and 2, each blade 15 and 16 in the illustrated louver 10 is formed from a strip of aluminum approximately three and one-quarter inches wide, although this may vary depending upon desired depth or thickness of the louver. The length of the strip is varied to accommodate varying demands in louver size. The illustrated louver 10, for example, is twenty-two inches square and, accordingly, its blades 15 and 16 are formed from strips of aluminum which are twenty-two inches long.

In the louver 10, seven blades 15 and seven blades 16 are nested together, although only three each are shown here. The blades 15 are spaced at three and one-half inch intervals, as are the blades 16. The intersecting blades 15 and 16, as shown in FIGS. 1 and 2, form square cells 20 through which light passes downwardly from the fluorescent lighting fixtures (not shown) conventionally mounted in a fixture above the louver.

Each blade 15, as seen in FIG. 5 in perspective about to be assembled with a mating blade 16, comprises a narrow base 25 from which bracketing, parabolically curved, lower sidewalls 26 extend upwardly and outwardly. The lower sidewalls 26 terminate at bend lines 27 approximately one and one-quarter inches upwardly from the base 25 and parabolically curved upper sidewalls 28 extend inwardly and upwardly from the bend lines.

The upper sidewalls 28 are approximately one-quarter inch wide. They terminate at bend lines 29. Extending horizontally inwardly from the bend lines 29 are edge strips 30 and 31. The edge strip 30 is one-eighth inch wide while the edge strip 31 is one-sixteenth inch wide.

The blades 15 are shaped on conventional roll-forming equipment to achieve the configuration described. Each blade 15, when shaped in this manner, is formed so that its lower sidewalls 26 diverge sufficiently that the edge strips 30 and 31 do not overlap. As will hereinafter be discussed, when the blade 15 is assembled with a blade 16, these lower sidewalls 26 are forced toward each other against their built-in, resilient, outward bias, and the edge strips 30 and 31 overlap to form a narrow cap on the blade.

At three and one-half inch intervals along the blade 15, wedge-shaped notches 35 are formed downwardly from the cap (strips 30 and 31), through the upper sidewalls 28, and through seven-eighths of an inch of the lower sidewalls 26. At the bottom of each notch a locking tab 36 extends upwardly in each lower sidewall 26, from the center of the notch 35.

At the bottom of each upper sidewall 28, where that sidewall meets its corresponding bend line 27, each notch 35 is formed so that an overhanging shoulder 38 remains. As such, there are four such overhanging shoulders 38 in each notch 35. As will hereinafter be discussed, the shoulders 38 are designed to lock the lower sidewalls 26 in a position which keeps the edge strips 30 and 31 overlapped when the blades 15 are properly assembled with blades 16.

The notches 35 are die cut with conventional stamping equipment before the aluminum strips which make up the blades 15 are roll formed. As best seen in FIG. 5, the endmost notches 35 in each blade 15 are actually only partial notches, i.e., their outer edges are truncated, as at 39.

Each blade 16 is roll formed in a manner identical to the blades 15. In this regard, each blade 16 comprises a narrow base 45 from which bracketing, parabolically curved, lower sidewalls 46 extend upwardly and outwardly. The lower sidewalls 46 terminate at bend lines 47, approximately one and one-quarter inches upwardly from the base 45, and parabolically curved upper sidewalls 48 extend inwardly and upwardly from the bend lines.

The upper sidewalls 48 are approximately one-quarter inch wide. They terminate at bend lines 49. Extending horizontally inwardly from the bend lines 49 are edge strips 50 and 51. The edge strip 50 is one-eighth inch wide while the edge strip 51 is one-sixteenth inch wide.

The blades 16 are also shaped on conventional roll-forming equipment so that their lower sidewalls 46 diverge sufficiently that the edge strips 50 and 51 do not overlap. When the blade 16 is assembled with a blade 15, these lower sidewalls 46 are forced toward each other against a resilient bias tending to keep them apart and the edge strips 50 and 51 overlap to form a narrow cap on the blade 16.

At three and one-half inch wide intervals along the blade 16, a spacing corresponding to the spacing of the notches 35 in the blades 15, narrow notches 55 are formed upwardly from the base 45, through one-half inch of the lower sidewalls 46. At the top of each notch 55 a locking tab 56 extends downwardly in each lower sidewall 46, positioned in the center of each notch.

At the bottom of each upper sidewall 48 in the blade 16, where that sidewall meets its corresponding bend line 47, a horizontally spaced pair of apertures 58 are die cut through these upper sidewalls. As will hereinafter be discussed, these apertures 58 are adapted to receive the shoulders 38 in corresponding notches 35 of the blades 15 to lock the lower sidewalls 26 of the blades 15 in a position which keeps its edge strips 30 and 31 overlapped.

To assemble the louver 10 from seven each of the blades 15 and 16, each blade 16 is pressed downwardly onto seven blades 15 with corresponding notches 35 and 55 in alignment. The mating of each blade 16 notch 55 with each blade 15 notch 35 involves the same nesting and cooperation of elements.

As best seen in FIG. 5, with reference to FIGS. 3 and 4, the blade 16 slides down into a corresponding notch 35 in a blade 15 until the locking tabs 56 protrude downwardly between lower sidewalls 26 of the blade 15 and the locking tabs 36 extend upwardly between lower sidewalls 46 of the blade 16. The blade 15 is seated properly when the narrow base 25 of blade 15 is flush with the narrow base 45 of blade 16.

In this relationship the lower sidewalls 46 of the blade 16 have been forced toward each other by engagement with the notch 35 until the edge strips 50 and 51 are fully overlapped. At this point the louver sidewalls 26 of the blade 15 have been forced toward each other by engagement with the notch 55 in the blade 16. To assure that the edge strips 30 and 31 are in fully overlapped relationship, the upper sidewalls 28 of the blade 15 continue to be pressed together by manual or automatic means until the locking shoulders 38 snap into corresponding apertures 58 in the upper sidewalls of the blade 16.

Each blade 15 is assembled with each blade 16 so that corresponding notches 35 and 55 nest in the aforedescribed manner. Of course, at the outer periphery of the louver 10 nesting of the blades 15 and 16 is modified slightly by virtue of the existence of truncated outer edges 39 on the blade lower sidewalls 26. However, the self-locking effect of nesting all the blades 15 and 16 is not affected.

It will now be seen that a louver 10 has been assembled from sheet aluminum blades 15 and 16 without separate locking elements and the top of each blade 15 and 16 is closed by overlapping edge strips so that light from a source above is not lost in the bowels of the blades. In addition, the upper sidewalls 28 and 48 of the blades are parabolically curved to reflect and direct light rays in a highly advantageous manner as it travels from its source above the louver 10 to a room below.

Figure 6:
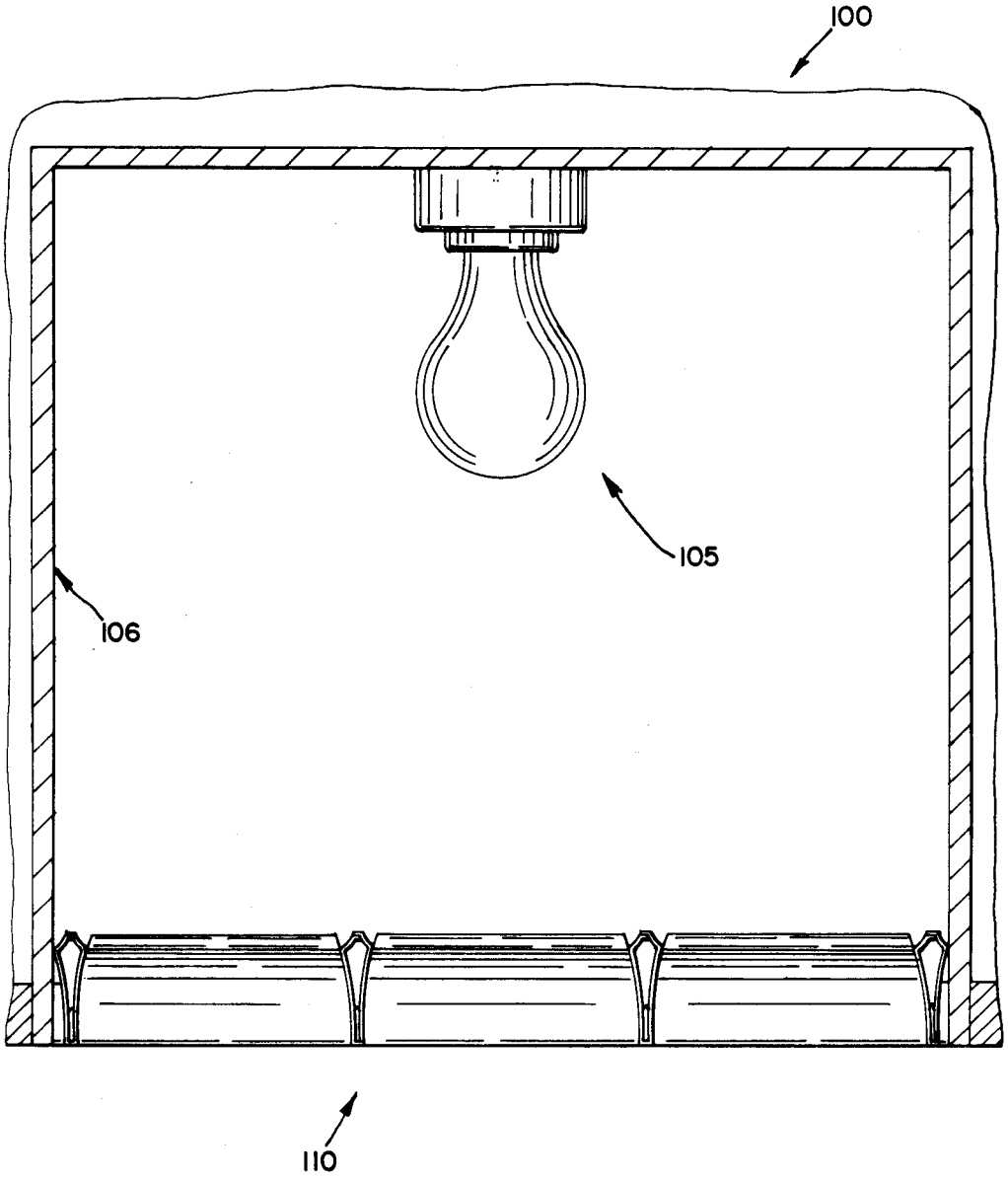
FIG. 6 is a vertical sectional view through an incandescent, or HID lamp, light fixture embodying features of the present invention.

Referring now to FIG. 6, a light fixture embodying features of the present invention is illustrated generally at 100. The fixture 100 comprises a plurality of incandescent or HID lamps 105 mounted in a light box 106, positioned over a louver 110. The louver 110 is adapted to modify the rays of light emitted downwardly from the lamps 105.

The louver 110 is a louver identical to the louver 10 hereinbefore discussed, i.e., it embodies features of the present invention. The louver 110 is normally positioned so that the cap formed by its upper edge strips is positioned approximately six inches below the lamps 105.

Light emitted from the incandescent lamps 105 strikes, and is reflected by, parabolic surfaces on both the upper sidewalls and lower sidewalls of the louver 110 blades. These blades are constructed and arranged as described in relation to the louver 10, of course. Because the blades 110 are metal, they are relatively impervious to heat damage. Because they have double parabolic sidewall surfaces and closed caps, they provide greatly enhanced light transmission; a 33% enhancement according to tests run by an independent testing company.

While the preferred embodiment of the invention has been disclosed, it is understood that the invention is not limited to the disclosed example. Modifications in addition to those discussed can be made without departing from the invention. The scope of the invention is indicated in the appended claims, and all changes that come within the meaning and range of equivalency of the claims are therefore intended to be embraced therein.

We claim:

1. A louver for a light box, or the like, comprising:

(a) a plurality of longitudinally extending blades formed of sheet metal;

(b) a plurality of transversely extending blades formed of sheet metal;

(c) each of said blades having (i) a base, (ii) a pair of parabolically shaped lower sidewalls extending upwardly and outwardly from said base and terminating in an edge line, (iii) a pair of parabolically shaped upper sidewalls extending upwardly and upwardly from said edge line, and (iv) a a pair of edge strips extending toward each other from said upper sidewalls to form a cap and a closed blade;

(d) said longitudinally and transversely extending blades being nested together at corresponding notches formed in each blade.

2. The louver of claim 1 further characterized in that:

(a) said edge strips overlap to form a closed blade in each of said blades.

3. The louver of claim 1 further characterized in that:

(a) one of said longitudinally extending and horizontally extending blades has nesting notches formed downwardly from said cap and the other has nesting notches formed upwardly from said base;

(b) shoulders extending from said upper sidewalls in said downwardly formed notches;

(c) said shoulders seated in apertures formed in said upper sidewalls of said blocks with upwardly formed notches.

4. The louver of claim 1 further characterized in that:

(a) said base and said lower sidewalls of each of said blades are formed so that said lower sidewalls are forced toward each other against a resilient bias when the blades are nested together.

5. A light fixture, comprising:

(a) incandescent or HID light means;

(b) a louver positioned below said light means;

(c) said louver including a plurality of longitudinally extending blades formed of sheet metal and a plurality of transversely extending blades formed of sheet metal;

(d) each of said blades having (i) a base, (ii) a pair of parabolically shaped lower sidewalls extending upwardly and outwardly from said base and terminating in an edge line, (iii) a pair of parabolically shaped upper sidewalls extending upwardly and upwardly from said edge line, and (iv) a closed cap.

* * * * *